US007690356B2

(12) United States Patent
Hotta et al.

(10) Patent No.: US 7,690,356 B2
(45) Date of Patent: Apr. 6, 2010

(54) INTERNAL COMBUSTION ENGINE

(75) Inventors: Kazuhito Hotta, Wako (JP); Junya Sato, Wako (JP); Yuji Kashiwabara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/394,753

(22) Filed: Feb. 27, 2009

(65) Prior Publication Data

US 2009/0241902 A1 Oct. 1, 2009

(30) Foreign Application Priority Data

Mar. 26, 2008 (JP) ..... 2008-080342

(51) Int. Cl.
*F02M 69/46* (2006.01)
*F02M 55/02* (2006.01)

(52) U.S. Cl. ..... 123/456; 123/467; 123/468

(58) Field of Classification Search ..... 123/456, 123/467, 468, 469, 470; 138/26–30
See application file for complete search history.

(56) References Cited

U.S. PATENT DOCUMENTS 4,205,637 A * 6/1980 Ito et al. ..... 123/447
4,300,510 A * 11/1981 Ishida et al. ..... 123/512
4,615,320 A * 10/1986 Fehrenbach et al. ..... 123/467
4,679,537 A * 7/1987 Fehrenbach et al. ..... 123/447
5,088,463 A * 2/1992 Affeldt et al. ..... 123/459
5,505,181 A * 4/1996 McRae et al. ..... 123/510
5,845,621 A * 12/1998 Robinson et al. ..... 123/456
5,954,031 A * 9/1999 Ogiso et al. ..... 123/447
6,148,798 A * 11/2000 Braun et al. ..... 123/467
6,155,235 A * 12/2000 Kilgore ..... 123/467
6,321,719 B1 * 11/2001 Schwegler ..... 123/467
6,336,442 B1 * 1/2002 Kilgore ..... 123/456
6,431,149 B1 * 8/2002 Schwegler et al. ..... 123/467
6,651,627 B2 * 11/2003 Zdroik et al. ..... 123/456
6,901,964 B2 * 6/2005 Kippe et al. ..... 138/30
6,925,989 B2 * 8/2005 Treusch et al. ..... 123/456
2008/0178846 A1 * 7/2008 Matsuda ..... 123/456

FOREIGN PATENT DOCUMENTS

JP 2005-069033 A 3/2005

* cited by examiner

*Primary Examiner*—Thomas N Moulis
(74) *Attorney, Agent, or Firm*—Westerman, Hattori, Daniels & Adrian, LLP

(57) ABSTRACT

An internal combustion engine includes a cylinder head having a plurality of intake ports; throttle devices including a plurality of respective intake passages equipped with throttle valves therein; a plurality of fuel injection valves for injecting fuel into the corresponding intake passages; a fuel pipe adapted to supply fuel to the fuel injection valves; and a pulsation damper connected to the fuel pipe to damp fuel pressure pulsation. In the engine, a connection pipe coupled to the pulsation damper is formed between a plurality of branch portions with respect a longitudinal direction of the fuel pipe, adapted to deliver fuel from the fuel pipe to the fuel injection valves and the connection pipe is disposed to at least partially overlap the fuel injection valve as viewed from the longitudinal direction of the fuel pipe.

6 Claims, 9 Drawing Sheets

INTERNAL COMBUSTION ENGINE

TECHNICAL FIELD

The present invention relates generally to internal combustion engines such as V-type internal combustion engines, and specifically, to an improvement in the arrangement of a pulsation damper mounted to a fuel pipe adapted to deliver fuel to a plurality of fuel injection valves.

BACKGROUND OF THE INVENTION

An internal combustion engine is provided with a pulsation damper for damping pressure pulsation of fuel in a fuel pipe adapted to deliver fuel to a plurality of fuel injection valves. In general, the pulsation damper has been disposed at the longitudinal end of the fuel pipe in the past (see e.g. Japanese Patent Laid-open No. 2005-69033).

In the internal combustion engine described in Japanese Patent Laid-open No. 2005-69033, since the pulsation damper is disposed at the longitudinal end of the fuel pipe, the fuel pipe is increased in length, thus inhibiting the entire engine, including the fuel pipe, from being made compact.

SUMMARY OF THE INVENTION

The present invention has overcome such a problem and it is an object of the invention to provide an internal combustion engine that can achieve the compactness of the entire engine without increasing the length of a fuel pipe.

The invention is an internal combustion engine including a cylinder head fastened to a cylinder block and having a plurality of intake ports; throttle devices including a plurality of respective intake passages each equipped with a throttle valve therein, the intake passages communicating with the respective intake ports; a plurality of fuel injection valves for injecting fuel into the corresponding intake passages; a fuel pipe adapted to supply fuel to the plurality of fuel injection valves; and a pulsation damper connected to the fuel pipe to damp fuel pressure pulsation; and is characterized in that a connection pipe coupled to the pulsation damper is formed between a plurality of branch portions, with respect a longitudinal direction of the fuel pipe, and is characterized in that the connection pipe coupled to the pulsation damper at least partially overlaps the fuel injection valve as viewed from the longitudinal direction of the fuel pipe.

The invention is further characterized in that, in the internal combustion engine recited above, the throttle devices are provided with the respective intake passages corresponding to the plurality of respective fuel injection valves and the pulsation damper is disposed at a position between intake passages adjacent to each other with respect to the longitudinal direction of the fuel pipe.

The invention is further characterized in that, in the internal combustion engine recited above, two banks including the cylinder block, the cylinder heads and the throttle devices are arranged to have V-shaped cylinder axes as viewed from a crankshaft direction; while the cylinder axes are V-shaped as viewed from the crankshaft direction, the fuel injection valves are arranged in an inverse V-shape as viewed from the crankshaft direction; and a throttle valve control actuator is disposed at a position between the intake passages of the two banks.

The invention is further characterized in that, in the internal combustion engine recited above, the pulsation damper is disposed to be exposed at a position between two joint portions forming a joint between the throttle devices with the corresponding cylinder heads, the joint portions being adjacent to each other with respect to a longitudinal direction of the fuel pipe.

The invention is further characterized in that, in the internal combustion engine recited above, a 4-cylinder engine is constructed of the two banks each including two cylinders; the throttle devices are formed with the intake passages corresponding to the four respective cylinders; the throttle valve control actuator is connected to the throttle valve of the throttle device via a link mechanism; the link mechanism is disposed between adjacent intake passages of one of the banks; and the pulsation damper is disposed between adjacent intake passages of the other bank.

In the invention, the connection pipe coupled to the pulsation damper is formed between a plurality of branch portions, with respect the longitudinal direction of the fuel pipe, and the pulsation damper is coupled to the connection pipe. In other words, the pulsation damper is disposed not at the longitudinal end of the fuel pipe but in the dead space at the intermediate portion of the fuel pipe. Thus, the fuel pipe is reduced in longitudinal size to make the engine compact. In addition, the fuel pipe coupled to the pulsation damper is disposed to at least partially overlap the fuel injection valve as viewed from the longitudinal direction of the fuel pipe. Therefore, the connection pipe coupled to the pulsation damper and the fuel injection valve extend in a substantially parallel direction. Thus, an increase in size otherwise due to the fact that both extend in directions different from each other can be avoided to thereby make the engine compact.

In the invention, the throttle devices are provided with the respective intake passages corresponding to the plurality of respective fuel injection valves and the pulsation damper is disposed at a position between intake passages adjacent to each other with respect to the longitudinal direction of the fuel pipe. Therefore, the pulsation damper is fitted in the frame of the throttle devices, that is, it does not project outwardly therefrom. The external projection of the pulsation damper is reduced to improve the flexibility of arrangement of components on the periphery of the throttle devices.

In the invention, in the V-type engine the throttle valve control actuator of the throttle device is disposed at a position between the intake passages of the two banks; therefore, although both the pulsation damper and the throttle valve control actuator are mounted to the engine, an effect of preventing the engine from growing in size can be provided.

In the invention, the pulsation damper is disposed to be exposed at a position between two joint portions forming a joint between the throttle devices and the corresponding cylinder heads, the joint portions being adjacent to each other with respect to a longitudinal direction of the fuel pipe. Therefore, the dead space produced between the joint portions between the throttle devices and the corresponding cylinder heads is used as a place for installing the pulsation damper thereat, to thereby downsize the entire engine.

In the invention, in the 4-cylinder engine having the two banks, the link mechanism connecting the throttle valves is disposed between the adjacent intake passages of one of the two banks and the pulsation damper is disposed between the adjacent intake passages of the other bank. Therefore, the space between the intake passages of each bank is effectively utilized to achieve the compactness of the throttle device portion.

BRIEF DESCRIPTION OF THE DRAWINGS

The advantages of the invention will become apparent in the following description taken in conjunction with the drawings, wherein.

DETAILED DESCRIPTION OF THE INVENTION

An embodiment of the present invention will hereinafter be described with reference to the drawings.

Figure 1:
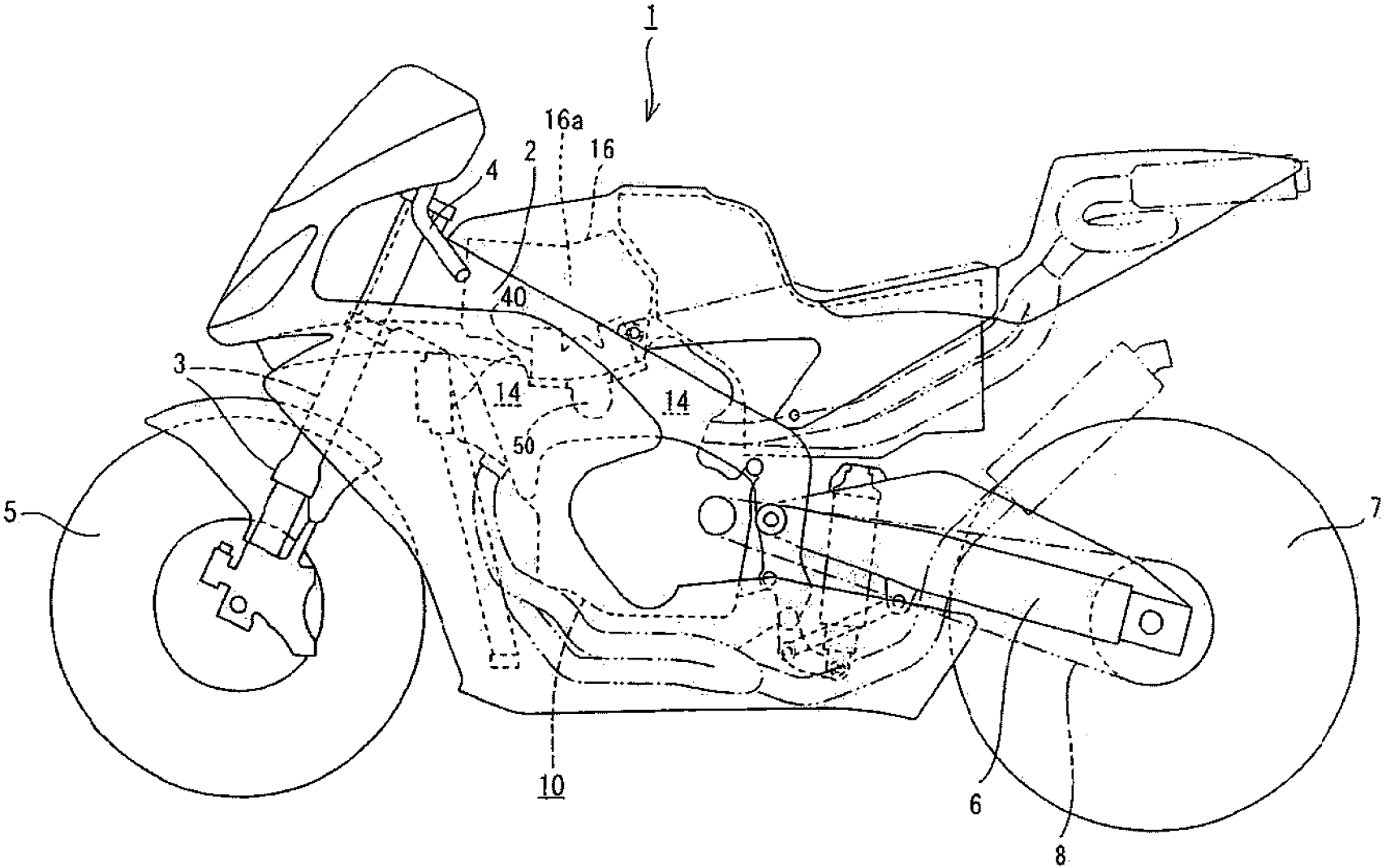
FIG. 1 is a lateral view of a motorcycle mounted with an internal combustion engine according to the present invention.

FIG. 1 illustrates an internal combustion engine 10 according to the present invention mounted on a motorcycle 1. In the embodiment shown in the figure, the internal combustion engine 10 is a V-type internal combustion engine. A front fork 3 is provided at the front end of a main frame 2 of the motorcycle 1 so as to be turnable from side to side. A steering handlebar 4 is integrally mounted to the upper end of the front fork 3. A front wheel 5 is rotatably supported by the lower portion of the front fork 3. A rear fork 6 is vertically swingably provided at the rear portion of the main frame 2. A rear wheel 7 is rotatably supported by the rear end of the rear fork 6. The rear wheel 7 is rotatably driven by the power from the engine 10 via a chain transmission system 8.

Figure 2:
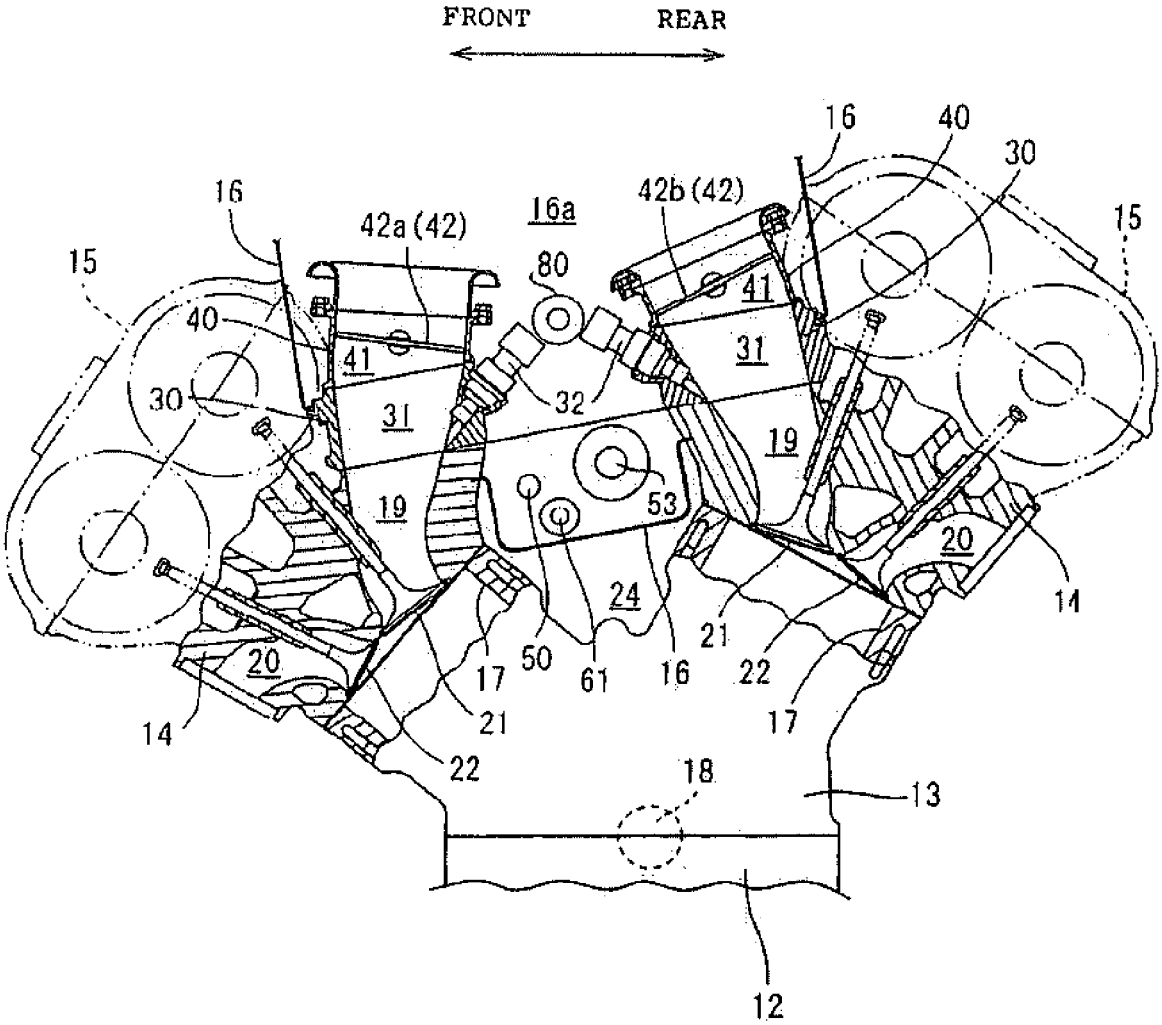
FIG. 2 is a partial cross-sectional lateral view illustrating an essential portion including the internal combustion engine, cylinder heads, and throttle devices, fuel injections, etc., according to the present invention.

The internal combustion engine 10 is a 4-cylinder DOHC internal combustion engine with two cylinders for each of two banks arranged in a V-shape in a forward and backward direction. As shown in FIG. 2, a V-shaped cylinder block 13 is joined to the upper portion of a crankcase 12. Front and rear cylinder heads 14, 14 pertaining, respectively, to front and rear banks are joined to the upper portion of the cylinder block 13. A head cover 15 is mounted to the upper portion of each cylinder head 14. An air chamber wall 16 forming an air chamber 16*a* adapted to take in fresh air is disposed above the air chamber wall 16*a* and between the front cylinder head 14 and head cover 15 and the rear cylinder head 14 and head cover 15. A space 24 exists between the two banks arranged in the V-shape. In the space 24, the air chamber wall 16 forming the bottom wall of the air chamber 16*a* spans between both the banks. The air chamber wall 16 is provided with an opening (not shown) toward the front of a vehicle body. A filter (not shown) is attached to the opening as required.

Pistons (not shown) are each slidably fitted into the front and rear cylinders 17 of the cylinder head 13. A crankshaft 18 is rotatably supported at a mating surface between the crankcase 12 and the cylinder block 13. A connecting rod (not shown) is rotatably supported at both ends by the piston and the crankshaft 18 so that the crankshaft 18 is rotatably driven in response to the upward and downward movement of the piston. The two banks arranged in a V-shape have cylinder axes formed in a V-shape as viewed from the axis of the crankshaft 18.

Intake ports 19 are provided in the corresponding cylinder heads 14 so as to be located on the respective insides thereof, i.e., on the sides where the front and rear cylinder heads 14 are adjacent to each other. In addition, exhaust ports 20 are provided in the corresponding cylinder heads 14 so as to be located on the respective outsides, i.e., on the sides where the front and rear cylinder heads 14 are separate from each other. Intake valves 21 and exhaust valves 22 are provided at the intake ports 19 and exhaust ports 20, respectively, in openable and closable manner. The intake valves 21 and the exhaust valves 22 are drivingly opened and closed at a predetermined timing by a valve train (not shown) for each two rotations of the crankshaft 18.

A throttle body connecting body 30 is joined to the upper surfaces of the front and rear cylinder heads 14 so as to be located at the areas of the intake ports 19. The throttle body connecting body 30 is provided with intake passages 31 therein. The intake passages 31 are smoothly joined to the corresponding intake ports 19. A throttle body 40 is joined to the upper surface of the throttle body connecting body 30. The throttle body 40 includes an intake passage 41 therein, in which a throttle valve 42 is turnably provided. The throttle valve 42 of the intake passage 41 pertaining to the vehicle body front bank is denoted with reference numeral 42*a* and the throttle valve 42 of the intake passage 41 pertaining to the vehicle body rear bank is denoted with reference numeral 42*b*.

A fuel injection valve 32 for injecting fuel into each intake passage 31 of the throttle body connecting body 30 is attached to the lateral surface of the throttle body connecting body 30. The fuel injection valves 32, 32 are arranged in an inverse V-shape as viewed from the axial direction of the crankshaft 18. That is, they are set in a fuel injecting direction having a directional component of intake air flowing in the intake passage 31.

Figure 3:
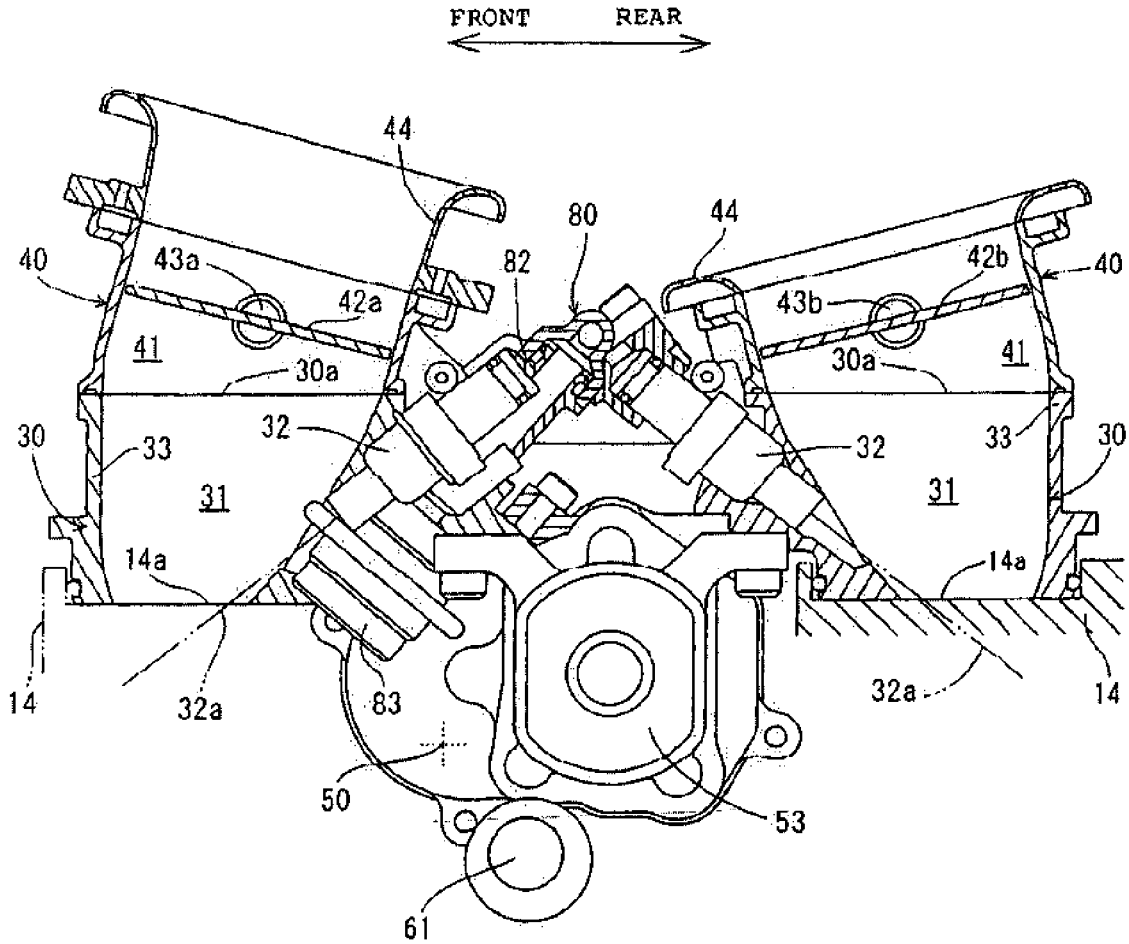
FIG. 3 is an enlarged, partial cross-sectional lateral view illustrating a portion of FIG. 2.

FIG. 3 is an enlarged view illustrating a portion including the throttle body connecting body 30, the throttle body 40 and the fuel injection valve 32. As shown in FIG. 3, the throttle body connecting body 30 is hermetically fastened to the cylinder head 14 with its lower portion fitted into a recessed portion formed in the upper surface of the cylinder head 14 via an O-ring. The throttle body 40 is hermetically fastened to the throttle body connecting body 30 with its flat lower end face abutted against a flat upper surface 30*a* of the throttle body connecting body 30. The throttle vales 42*a* and 42*b* are turnably supported in the intake passages 41 by valve shafts 43*a* and 43*b*. A guide member 44 having a curve adapted to guide intake air from the inside of the air chamber 16*a* is attached to the upper end of the throttle body 40. In FIG. 3, reference numeral 32*a* denotes a centerline of injection flow from the fuel injection valve 32. The throttle body connecting body 30 and the throttle body 40 constitute a throttle device.

Figure 4:
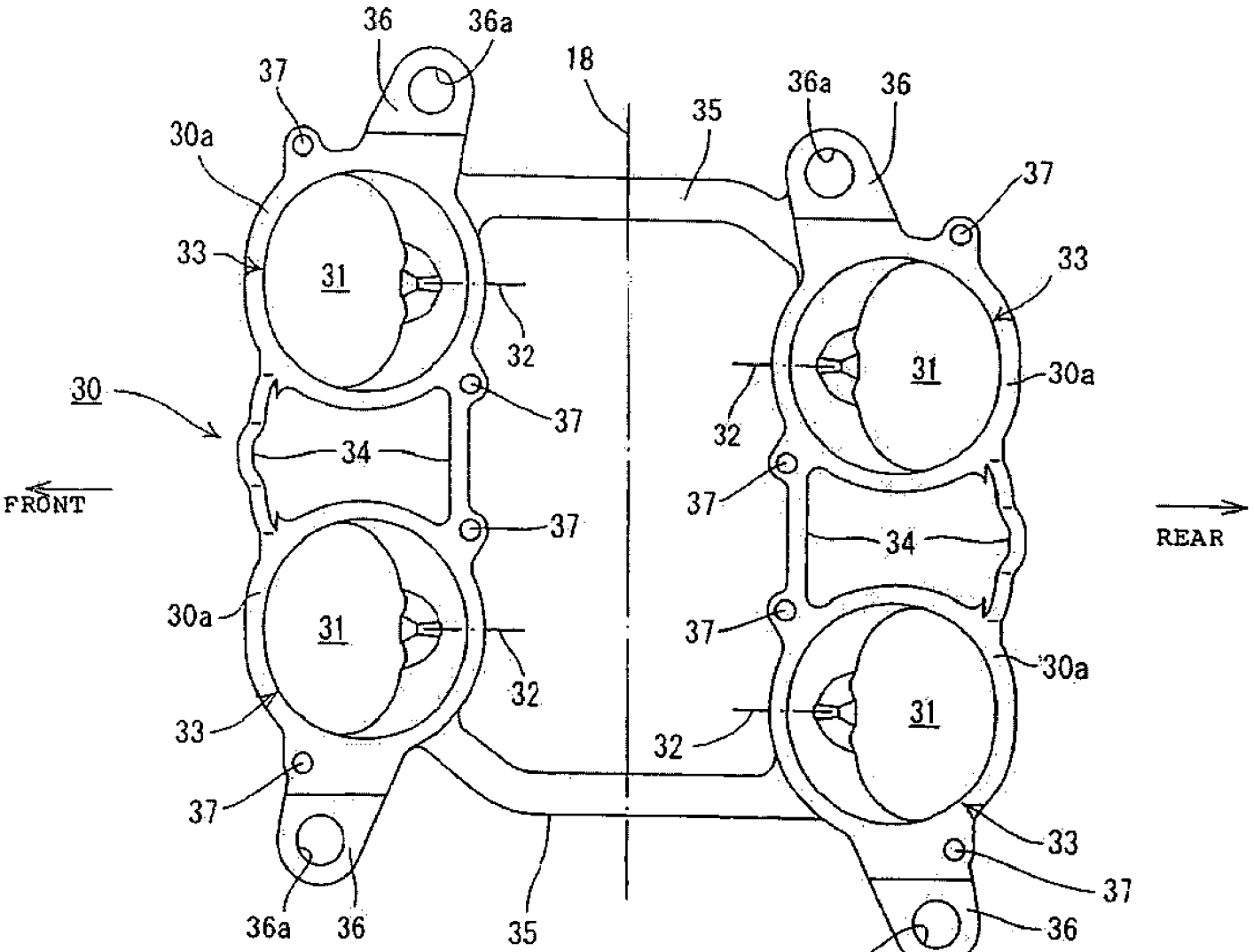
FIG. 4 is a top, plan view illustrating only a throttle body connecting body.

Referring to FIG. 4, which is a top, plan view, the throttle body connecting body 30 is provided with four cylindrical bodies 33 forming the intake passages 31 corresponding to the four cylinders in the cylinder block 13. Of the cylindrical bodies 33, cylindrical bodies 33 pertaining to the same bank are connected to each other by connecting pieces 34 arranged in a direction parallel to the crankshaft 18. In addition, cylindrical bodies 33 pertaining to different banks are connected to connecting parts 35. In this way, the four cylindrical bodies 33, the connecting pieces 34 and the connecting parts 35 are integrally connected to form a frame. The four cylindrical bodies 33 of the throttle body connecting body 30 have flat upper surfaces 30*a* formed to be flush with each other. Attachment portions 36 having attachment holes 36*a* protrude from the four corners of the frame-like throttle body connecting body 30. The throttle body connecting body 30 is fastened to the cylinder head 14 with bolts (not shown) passing through the attachment portions 36. The throttle body 40 and throttle body connecting body 30 constituting the throttle device are secured with bolts (not shown) passing through a plurality of attachment holes 37 of the throttle body connecting body 30 and through corresponding attachment holes of the throttle body 40.

Figure 5:
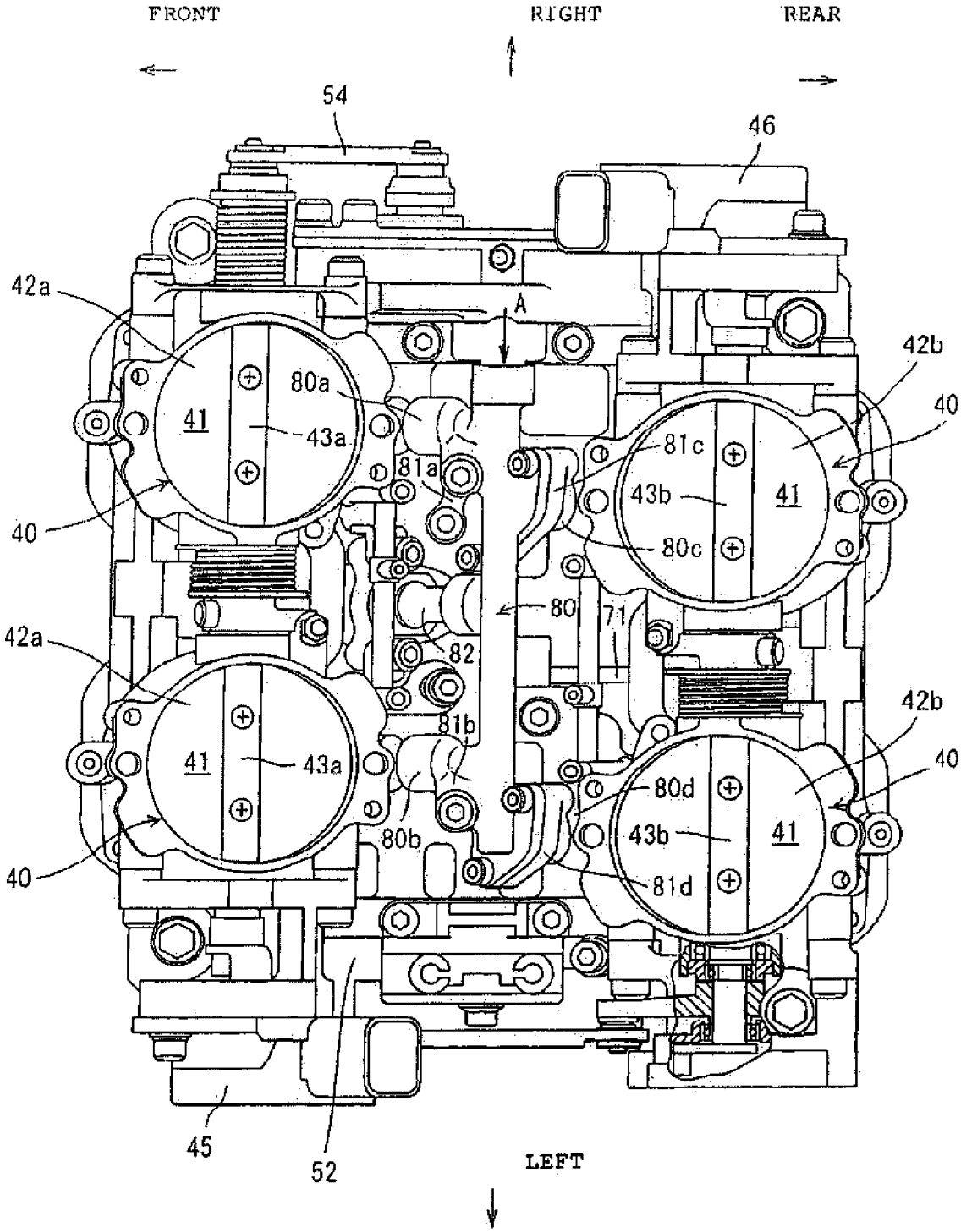
FIG. 5 is a top, plan view of FIG. 3.

Referring to FIG. 5 which is a top, plan view, a valve shaft 43*a* of a left throttle valve 42*a*, of the throttle valves pertaining to the front bank of the vehicle body, extends in the left-right direction of the vehicle body in parallel to the crankshaft 18. A first throttle opening angle sensor 45 for detecting the actual valve opening angle of the left throttle valve 42*a* is disposed on the left side of the vehicle body. The valve shafts 43*a* of the left and right throttle valves 42*a* pertaining to the front bank are composed of a single shaft. On the other hand, valve shafts 43*b*, 43*b* of the throttle valves 42*b*, 42*b* pertaining to the rear bank of the vehicle body extend in the left-right direction of the vehicle body in parallel to the crankshaft 18 and interlock with each other. A second throttle opening angle sensor 46 is disposed on the right of the vehicle body and connected to the valve shaft 43*b* of the right throttle valve 42*b* so as to be detect the actual opening angle of both the throttle valves 42*b*.

As shown in FIG. 2 and in FIG. 3 which is an enlarged view of FIG. 2, an operation input shaft 50 is turnably supported parallel to the crankshaft 18 in the space 24 between the front and rear V-shaped banks and between the fuel injection valves 32, 32 and the air chamber bottom wall 16. The operation input shaft 50 is supported by the throttle device via a stationary support structure. In addition, the operation input shaft 50 is also parallel to the throttle valve shafts 43*a*, 43*b* and extends in the left-right direction of the vehicle body.

Figure 6:
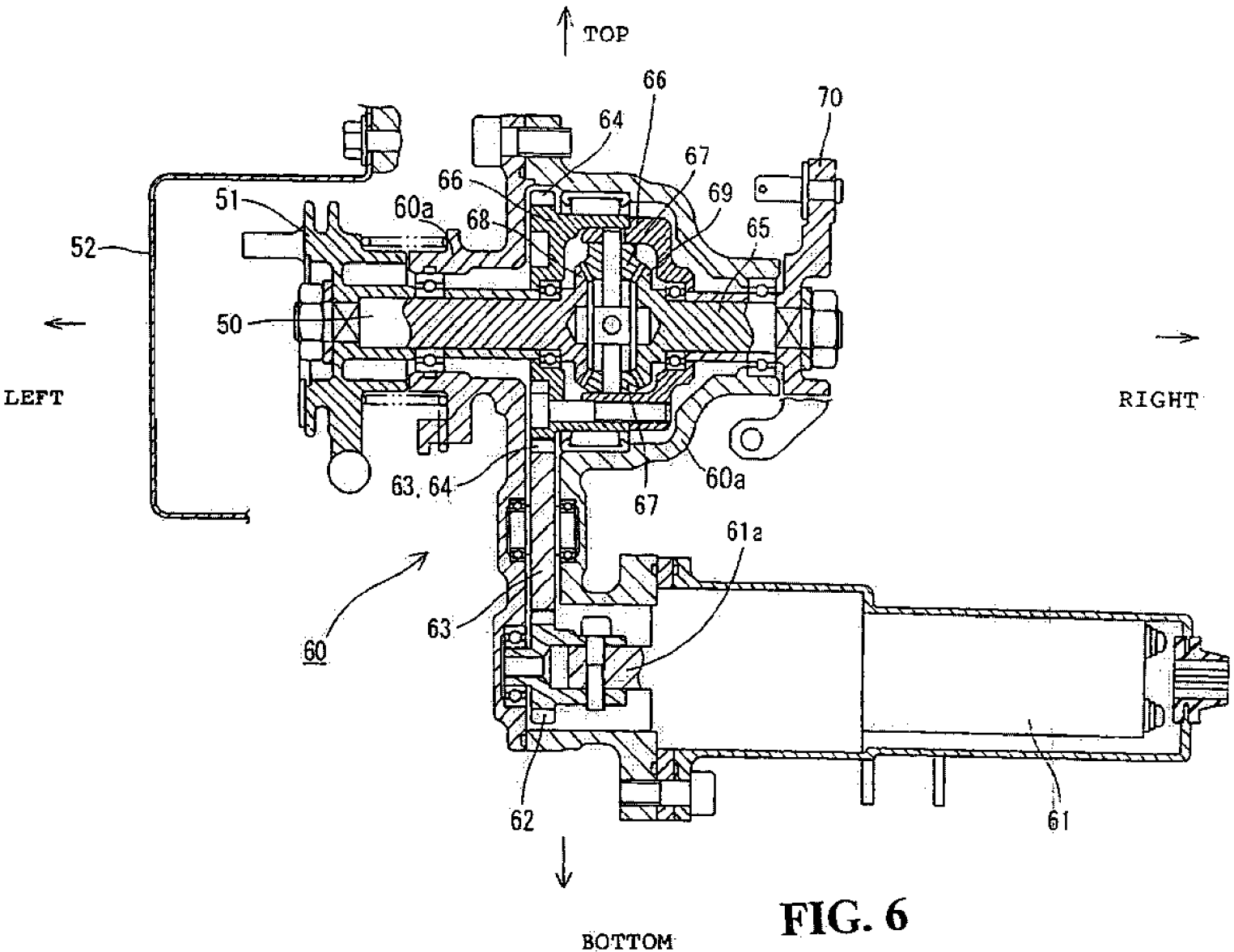
FIG. 6 is a cross-sectional lateral view of a differential throttle control device.

The operation input shaft 50 is detailed in FIG. 6. In FIG. 6, a wire drum 51 is integrally attached to the left end (the left end in FIG. 6) of the operation input shaft 50 in the vehicle traveling direction. The wire drum 51 is connected to the throttle grip of the steering handlebar 4 via a wire (not shown). In this way, the wire drum 51 is turnably driven in response to the turning angle of the throttle grip. An operation input turning angle sensor 52 (only its case is shown in FIG. 6) for detecting the turning angle of the operation input shaft 50 is provided at the left end of the operation input shaft 50. The operation input turning angle sensor 52 is disposed at a position adjacent to the throttle opening angle sensor 45 disposed on the vehicle traveling directional left side of the throttle valve 42*a* on the front bank.

Figure 7:
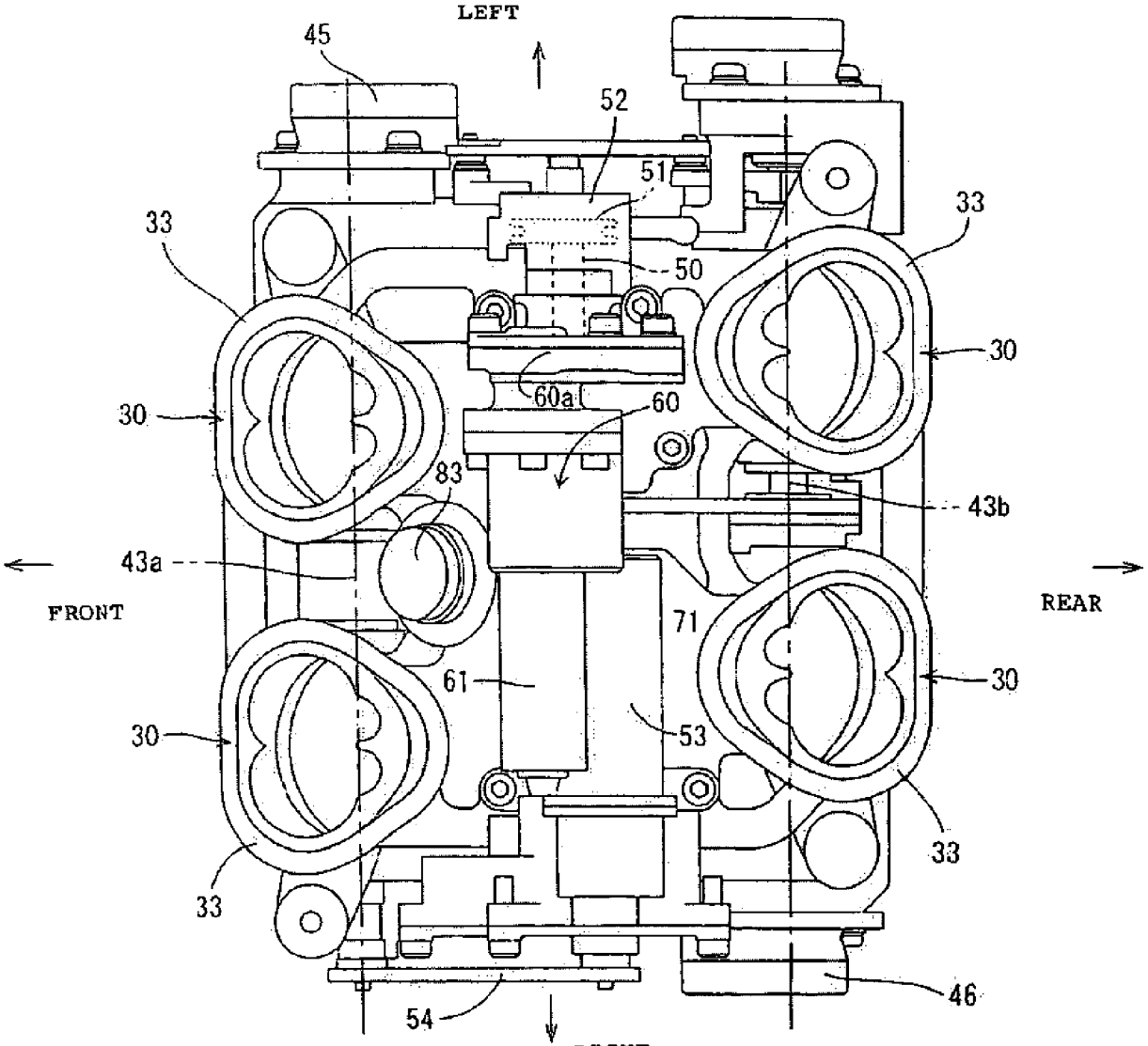
FIG. 7 is a bottom view of FIG. 5.

FIG. 7 is a bottom view illustrating the throttle devices each composed of the throttle body 40 and the throttle body connecting body 30, as viewed from the underside. In FIG. 7, reference numeral 60 denotes a differential throttle control device, which is supported below the throttle devices.

As shown in FIG. 6, the differential throttle control device 60 includes a throttle valve correcting actuator 61; a drive gear 62 integral with an output shaft 61*a* of the throttle valve correcting actuator 61; an intermediate gear 63 meshed with the drive gear 62; a correcting gear 64 meshed with the intermediate gear 63; a body 60*a* of the differential throttle control device 60; and an output shaft 65 located on the same axis as that of the operation input shaft 50 turnably supported by the body 60*a*, so as to be turnably supported by the body 60*a*. The differential throttle control device 60 includes a differential gear case 66 turnably fitted to the outer circumference of the operation input shaft 50 and of the output shaft 65; and a pair of differential small gears 67 supported by the differential gear case 66 for turning around an axis perpendicular to the operation input shaft 50 and to the output shaft 65. In addition, the differential throttle control device 60 includes a differential large gear 68 meshed with the pair of differential small gears 67 formed on the inner end of the operation input shaft 50; and a differential large gear 69 meshed with the pair of differential small gears 67 formed on the inner end of the output shaft 65. The arrangement of the differential throttle control device 60 is as shown in FIG. 7. The wire drum 51 located at the end of the operation input shaft 50 and the operation input turning angle sensor 52 are located in the vicinity of the first throttle opening angle sensor 45.

An output lever 70 (FIG. 6) is provided integrally with the output shaft 65 of the differential throttle control device 60. The output lever 70 is connected to the valve shaft 43*b* of the rear throttle valve 42*b* via the link mechanism 71 shown in FIG. 7. If the wire drum 51 is turnably driven in response to the turning angle of the throttle grip by the rider operator of the motorcycle 1, a difference between an operation input turning angle of the operation input shaft 50 integral with the wire drum 51 and a turning angle of the differential gear case 66 by the throttle valve correcting actuator 61 is transmitted to the valve shaft 43*b* of the rear throttle valve 42*b* via the output shaft 65 and the output lever 70. Thus, the throttle valve correcting actuator 61 of the differential throttle control device 60 is operated to correct, to an optimal throttle opening angle, the opening angle of the rear throttle valve 42*b* at that moment on the basis of the various parameters of the V-type internal combustion engine 10.

Referring to FIG. 3, the throttle valve control actuator 53 is disposed in the space 24 between the V-shaped front and rear banks, as well as below the fuel injection valves 32, 32 and above the bottom wall 16 of the air chamber 16*a*. The throttle valve control actuator 53 is designed to operate in response to the detected output of the operation input turning angle sensor 52. The installation position of the throttle valve control actuator 53 is as shown in FIG. 7. As with the differential throttle control device 60, the axial direction of the throttle valve control actuator 53 is equal to the left-right direction of the vehicle. The turning of the throttle valve control actuator 53 is transmitted to the valve shaft 43*a* of the front throttle valve 42*a* via the link mechanism 54 shown in FIGS. 5 and 7. Thus, the front throttle valve 42*a* is controllably opened and closed to supply an optimal amount of intake air required by the vehicle with respect to the turning angle of the throttle grip.

As shown in FIG. 3, a fuel pipe 80 adapted to supply fuel to the fuel injection valves 32, 32 is installed between the two front and rear banks. As shown in FIG. 5, the fuel pipe 80 is linearly installed in the left-right direction. As seen from FIG. 3, the fuel pipe 80 is installed at a height position close to the upper end, i.e., proximal portion of each of the fuel injection valves 32, 32 and higher than the throttle valve drive actuator 53. As shown in FIG. 5, the fuel pipe 80 has branch portions 80*a*, 80*b*, 80*c*, 80*d* located in a longitudinal halfway portion thereof to correspond to the four respective intake passages 31 (FIG. 3). These branch portions 80*a*, 80*b*, 80*c*, 80*d* are located at different longitudinal positions on the fuel pipe 80. Fuel pipe attachment portions 81*c*, 81*d* are projectingly formed close to the respective branch portions 80*c*, 80*d* located on the same side of the fuel pipe 80. The fuel pipe 80 is secured to the throttle devices with bolts or the like via the fuel pipe attachment portions 81*c*, 81*d*. Also, projecting portions 81*a*, 81*b* are formed close to the respective branch portions 80*a*, 80*b* located on the other side of the fuel supply pipe 80 and are secured to the throttle devices with bolts or the like. In this way, the fuel pipe 80 is secured to the throttle devices and fuel supplied from a fuel pump (not shown) is supplied into the fuel pipe 80 from a supply pipe (not shown) via one end of the fuel pipe 80 as shown with arrow A in FIG. 5.

As shown in FIG. 5, a connection pipe 82 is provided at the middle of the fuel pipe 80 to connect with a pulsation damper. The pulsation damper is adapted to damp the pressure pulsation of fuel in the fuel pipe 80. The connection pipe 82 is provided between the two branch portions 80*a*, 80*b* adjacent to one side of the fuel pipe 80. In addition, the connection pipe 82 extends forwardly and obliquely downwardly and connects at a leading end with the pulsation damper 83 shown in FIG. 3. The pulsation damper 83 and the connection pipe 82 are arranged to at least partially overlap the fuel injection valves 32 close thereto as viewed from the longitudinal direction of the fuel pipe 80. In other words, the pulsation damper 83 and the connection pipe 82 are arranged substantially parallel to the fuel injection valves 32 on both adjacent sides thereof.

Figure 8:
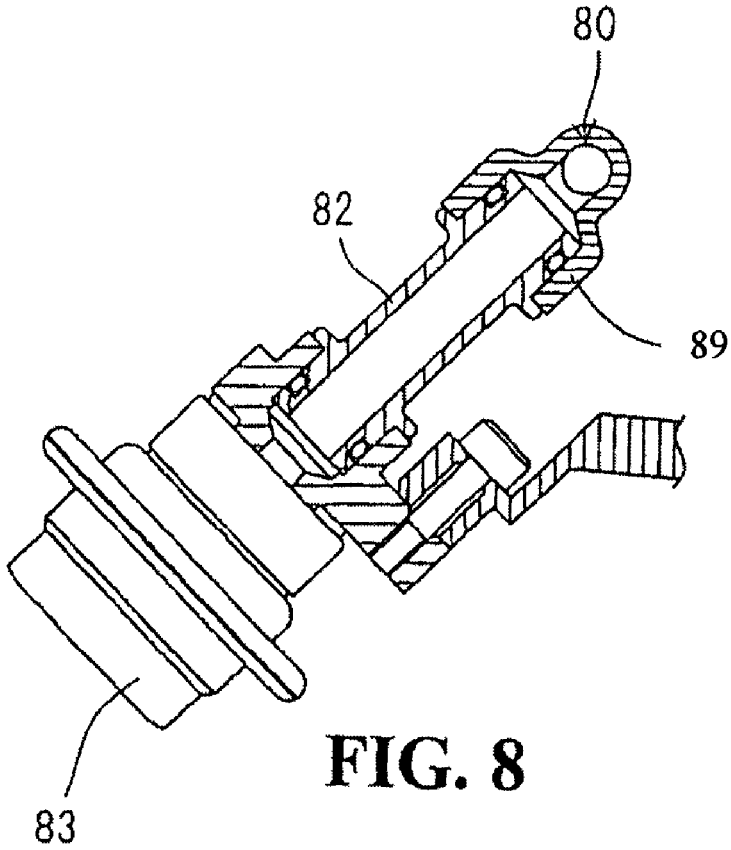
FIG. 8 is a partial cross-sectional lateral view illustrating a pulsation damper, its connecting pipe and fuel pipe.
Figure 9:
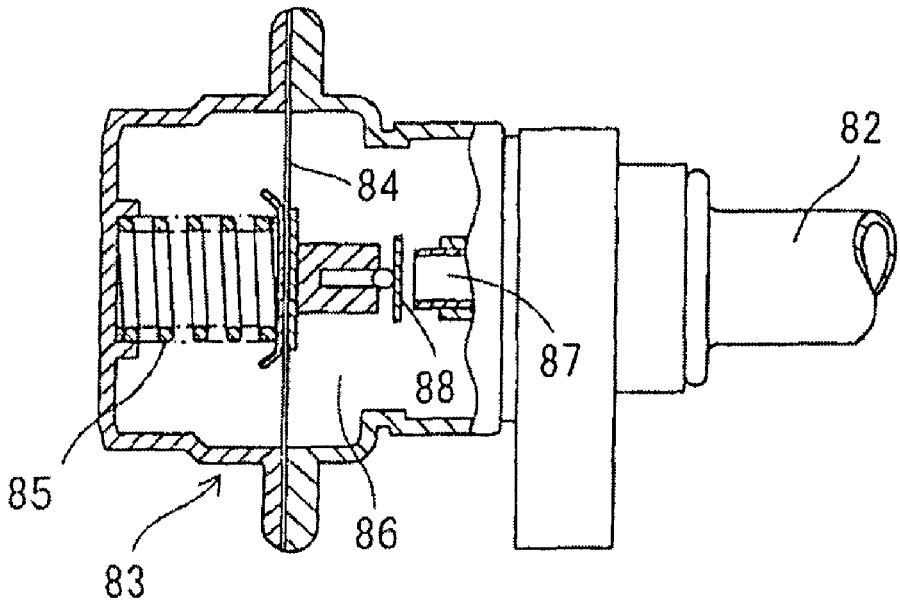
FIG. 9 is a principle view illustrating the inside of the pulsation damper.

The relationship between the pulsation damper 83 and the connection pipe 82 is illustrated in FIG. 8. The well-known pulsation damper 83 is attached to an end of the connection pipe 82 inserted into the connection pipe attachment portion 89 of the fuel pipe 80. As shown in the principle diagram of FIG. 9, a diaphragm 84 is set up inside the pulsation damper 83 to be partitioned into two sides. A spring 85 acting on the diaphragm 84 is installed on one side and the other side of the diaphragm 84 serves as a fuel chamber 86. Fuel is delivered into the fuel chamber 86 via the connection pipe 82. A valve body 88 is provided on a surface of the other side of the diaphragm 84 so as to open and close a valve seat of a fuel release passage 87. The position of the diaphragm 84 is determined by the state where force resulting from action of the fuel pressure in the fuel chamber 86 on the diaphragm 84 equals the force of the spring 85. If the fuel pressure inside the fuel chamber 86 is increased, the diaphragm 84 is shifted while compressing the spring 85. Consequently, the valve body 88 attached to the diaphragm 84 is separated from the valve seat of the fuel release passage 87 to admit fuel to enter the fuel release passage 87, thereby lowering fuel pressure. In this way, the pulsation damper 83 damps the pressure pulsation of fuel in the fuel pipe 80 communicating therewith. Incidentally, a passage from the connection pipe 82 into the fuel chamber 86 is omitted in FIG. 9. The pulsation damper 83 is a known one, whose configuration is not limited to the illustration of the figure.

Figure 10:
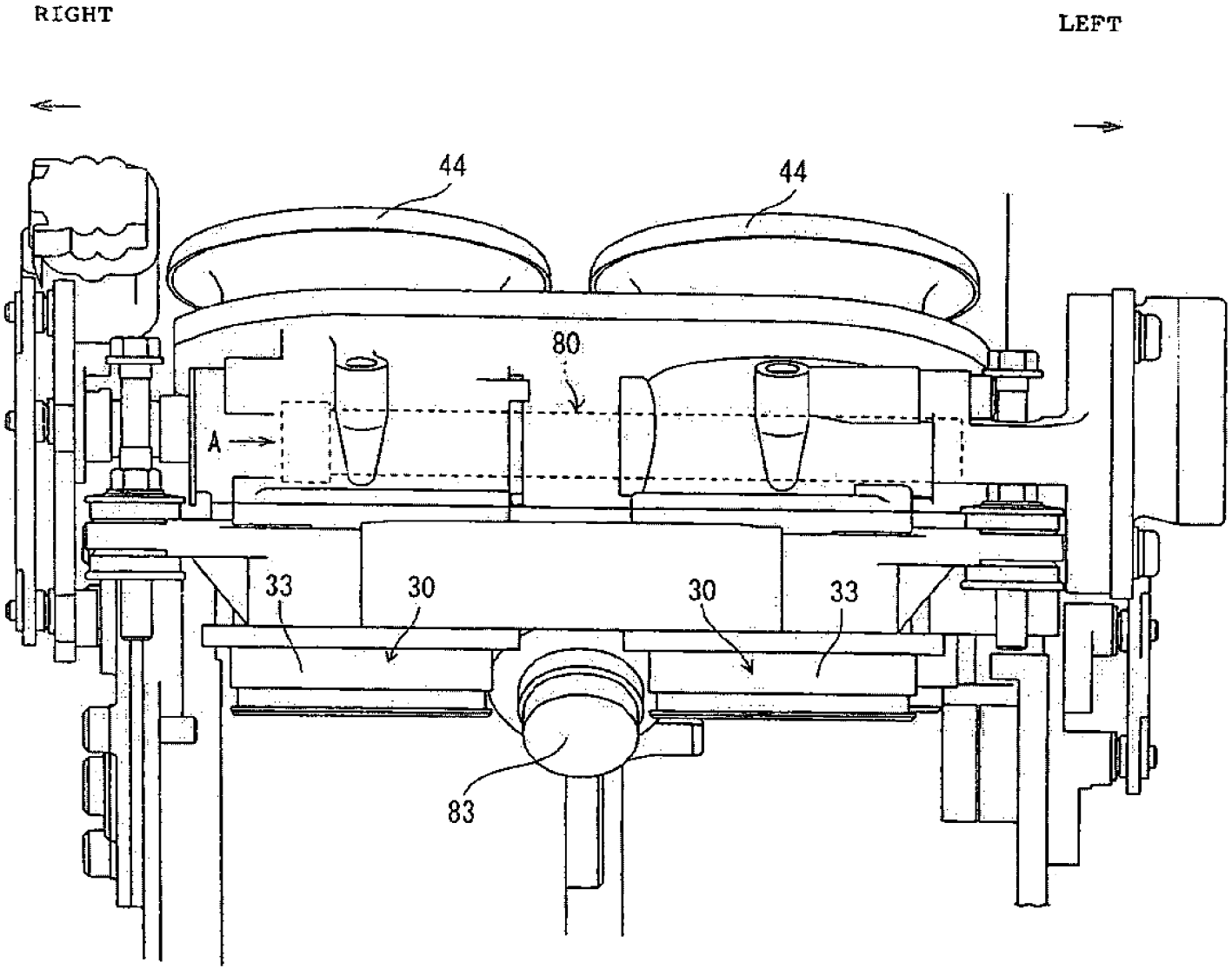
FIG. 10 is a front view of FIG. 5.

As shown in FIG. 7, the pulsation damper 83 is exposed to the downside. In addition, as seen from FIG. 3, the pulsation damper 83 is located between the left and right cylindrical bodies 33, which are part of the left and right throttle devices pertaining to the front bank. A portion of the cylinder head 14 in abutment against the lower surface of the cylindrical body 33 is cut out between the left and right cylinders 33. Therefore, the pulsation damper 83 is exposed to the cut-out portion toward the front and downside as shown in FIG. 10. As shown in FIG. 5, the pulsation damper 83 and the connection pipe 82 thereof project obliquely downwardly toward one side (the front side) of the fuel pipe 80 and are located between the left and right intake passages 41, 31 of the front bank. On the other hand, the link mechanism 71 (FIGS. 5 and 7) connected to the lever 70 (FIG. 6) of the throttle control device 60 extends toward the other side (the rear side) of the fuel pipe 80 and connects with the valve shaft 43*b* of the rear throttle valve 42*b*. Thus, the link mechanism 71 is located between the left and right intake passages 41, 31 of the rear bank.

Since the illustrated embodiment of the present invention is configured as described above, if the rider operator mounted on the motorcycle 1 twists the throttle grip in an accelerating direction, the wire drum 51 is turned in mechanical response to the turning angle of the throttle grip and the turning angle of the wire drum 51 is detected by the operation input turning angle sensor 52. The throttle valve control actuator 53 is operated in response to the detected output of the operation input turning angle sensor 52. Then, the turning of the throttle valve control actuator 53 is transmitted via the link mechanism 54 (FIGS. 7 and 5) to the valve shaft 43*a* of the throttle valves 42*a* of the front bank, thereby controllably opening and closing the throttle valves 42*a* of the front bank.

In addition, the turning of the wire drum 51 is transmitted as input of the differential throttle control device 60 to the differential large gear 68. This controls the throttle valves 42*b* of the rear bank via the link mechanism 71 to an optimal opening angle on the basis of the turning angle of the wire drum 51 and the turning angle of the throttle valve correcting actuator 61 operated to provide correction, leading to an optimal throttle opening angle based on the various parameters of the internal combustion engine 10 at the moment.

Furthermore, the respective detection signals of the first and second throttle opening angle sensors 45 and 46 provided at the respective shaft ends of the valve shafts 43*a* and 43*b* included in the front and rear bank throttle valves 42*a* and 42*b* are sent to a CPU (not shown). Thus, the control signals of the CPU control the fuel injection amount of the fuel injection valve 32.

In the embodiment of the present invention described above, the connection pipe 82 is formed, with respect to the longitudinal direction of the fuel pipe 80, between the plurality of branch portions 80*a*, 80*b* adapted to supply fuel from the connection pipe 82 to the plurality of fuel injection valves 32. In addition, the pulsation damper 83 is coupled to the connection pipe 82. Therefore, the pulsation damper 83 is disposed not at the longitudinal end of the fuel pipe 80 but in a dead space at the intermediate portion of the fuel pipe 80. Thus, the longitudinal size of the fuel pipe 80 is reduced to make the engine compact. In addition, the connection pipe 82 coupled to the pulsation damper 83 is arranged to at least partially overlap the fuel injection valves as viewed from the longitudinal direction of the fuel pipe 80. Therefore, the connection pipe 82 coupled to the pulsation damper 83 and the fuel injection valves 32 extend in a substantially parallel direction. Thus, an increase in size otherwise due to the fact that both the connection pipe 82 and the fuel injection valve 32 extend in directions different from each other can be avoided to thereby make the engine compact.

In the embodiment of the present invention, the throttle devices 30, 40 are provided with the intake passages 31, 41 so as to correspond to the plurality of fuel injection valves 32. In addition, the pulsation damper 83 is disposed at a position between the intake passages 31, 41 adjacent to each other with respect to the longitudinal direction of the fuel pipe 80. Thus, the pulsation damper 83 is fitted into the frame of the throttle devices 30, 40, that is, it does not project outwardly therefrom. The external projection of the pulsation damper 83 is reduced to improve the flexibility of arrangement of components on the periphery of the throttle devices 30, 40.

Further, in the V-type engine, the throttle valve control actuator 61 of the throttle devices 30, 40 is disposed at a position put between the intake passages 31, 41 of the two banks. Therefore, even though both the pulsation damper 83 and the throttle valve control actuator 61 are provided on the engine, the engine does not grow in size.

The pulsation damper 83 is disposed to be exposed between the joint portions 14*a* between the throttle devices 30, 40 and the corresponding cylinder heads 14, adjacent to each other with respect to the longitudinal direction of the fuel pipe 80. Thus, the dead space produced between the joint portions 14*a* between the throttle devices 30, 40 and the corresponding cylinder heads 14 is used as a place for installing the pulsation damper 83 to thereby downsize the entire engine.

Further, in the four-cylinder engine with two banks, the link mechanism 71 connecting the throttle valve 42*b* with the throttle valve control actuator 61 is disposed between the adjacent intake passages 31, 41 on one of the two banks. In addition, the pulsation damper 83 is disposed between the adjacent intake passages 31, 41 on the other bank. Thus, the space between the intake passages of each bank is effectively utilized to achieve the compactness of the throttle device portion.

In the embodiment, the operation input shaft 50 is disposed separately from the front and rear throttle valves 42*a*, 42*b* at almost a center between the respective valve shafts 43*a*, 43*b* of the throttle valves 42*a*, 42*b*. In addition, the operation input turning angle sensor 52 for detecting the turning angle of the operation input shaft 50 is provided only at one end of the operation input shaft 50. Thus, the operation input shaft 50, the front throttle valve 42*a* and the rear throttle valve 42*b* are each reduced in longitudinal size to allow for downsizing of the throttle devices 30, 40.

The throttle valve control actuator 53 and operation input shaft 50 operated in response to the turning of the throttle grip by the rider are arranged along the axial direction of the crankshaft 18. Thus, the valve shaft 43*a* of the front throttle valve 42*a*, one of the front and rear throttle valves 42*a*, 42*b*, is not mechanically connected to the operation input shaft 50 but is turnably driven by the throttle valve control actuator 53. Even though the operation input shaft 50 is separate from the valve shaft 43*a* of the front throttle valve 42*a*, a connection mechanism such as a link mechanism or the like is not required and additionally the V-bank space put between both the cylinder heads 14 of the V-type internal combustion engine 10 is effectively utilized to reasonably arrange the operation input shaft 50 and the throttle valve control actuator 53 in a compact manner. As a result, the aggregation of functional components can further downsize the throttle devices 30, 40.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. An internal combustion engine, comprising:

at least one cylinder head fastened to a cylinder block and having a plurality of intake ports;

a plurality of throttle devices each including an intake passage with a throttle valve therein, said intake passages communicating with said respective intake ports;

a plurality of fuel injection valves for injecting fuel into said corresponding intake passages;

a fuel pipe adapted to supply fuel to said plurality of fuel injection valves and including a plurality of branch portions;

a pulsation damper connected to said fuel pipe to damp fuel pressure pulsation; and a connection pipe coupled to said pulsation damper and said fuel pipe, said connection pipe being formed between at least two of said plurality of branch portions with respect a longitudinal direction of said fuel pipe, wherein said connection pipe at least partially overlaps at least one of said plurality of fuel injection valves, as viewed from the longitudinal direction of the fuel pipe.

2. The internal combustion engine according to claim 1, wherein said plurality of throttle devices correspond to said plurality of respective fuel injection valves, and wherein said pulsation damper is disposed at a position between said intake passages, with respect to the longitudinal direction of said fuel pipe.

3. The internal combustion engine according to claim 1, wherein said cylinder block, said at least one cylinder head and said plurality of throttle devices are arranged to form two banks having V-shaped cylinder axes, as viewed from a crankshaft direction;

wherein axes of said fuel injection valves are arranged in an inverse V-shape as viewed from the crankshaft direction; and wherein a throttle valve control actuator is disposed at a position between said intake passages of said two banks.

4. The internal combustion engine according to claim 2, wherein said plurality of throttle devices and said at least one cylinder head are joined at a plurality of joint portions, and wherein said pulsation damper is exposed at a position between said plurality of joint portions, with respect to a longitudinal direction of said fuel pipe.

5. The internal combustion engine according to claim 3, wherein said plurality of throttle devices and said at least one cylinder head are joined at a plurality of joint portions, and wherein said pulsation damper is exposed at a position between said plurality of joint portions, with respect to a longitudinal direction of said fuel pipe.

6. The internal combustion engine according to claim 3, wherein said internal combustion engine is a 4-cylinder engine having said two banks, each including two cylinders;

wherein said plurality of throttle devices are formed with said plurality of intake passages corresponding to the four respective cylinders;

wherein said throttle valve control actuator is connected to said throttle valves of said plurality of throttle devices via a link mechanism;

wherein said link mechanism is disposed between adjacent intake passages of one bank of said two banks; and wherein said pulsation damper is disposed between adjacent intake passages of the other bank of said two banks.

* * * * *